US009072937B2

(12) United States Patent
Katz

(10) Patent No.: US 9,072,937 B2
(45) Date of Patent: Jul. 7, 2015

(54) TRAINING APPARATUS FOR MUSCLES IN THE UPPER PART OF THE BODY

(75) Inventor: Karl Katz, Stockholm (SE)

(73) Assignee: KATZ TEKNIK AB (SE)

( * ) Notice: Subject to any disclaimer, the term of this patent is extended or adjusted under 35 U.S.C. 154(b) by 348 days.

(21) Appl. No.: 13/522,894

(22) PCT Filed: Jan. 17, 2011

(86) PCT No.: PCT/SE2011/050042

§ 371 (c)(1),
(2), (4) Date: Jul. 18, 2012

(87) PCT Pub. No.: WO2011/087444

PCT Pub. Date: Jul. 21, 2011

(65) Prior Publication Data

US 2012/0302413 A1 Nov. 29, 2012

(30) Foreign Application Priority Data

Jan. 18, 2010 (SE) ..... 1000039

(51) Int. Cl.

| | |
|---|---|
| ***A63B 21/00*** | (2006.01) |
| ***A63B 23/12*** | (2006.01) |
| ***A63B 21/068*** | (2006.01) |
| *A63B 21/078* | (2006.01) |

(52) U.S. Cl.

CPC ..... *A63B 23/12* (2013.01); *A63B 21/068* (2013.01); *A63B 21/078* (2013.01); *A63B 23/1227* (2013.01); *A63B 2208/0252* (2013.01)

(58) Field of Classification Search

USPC ..... 482/72, 95, 96

See application file for complete search history.

(56) References Cited

U.S. PATENT DOCUMENTS

| | | | | |
|---|---|---|---|---|
| 4,300,760 | A | 11/1981 | Bobroff | |
| 5,304,107 | A * | 4/1994 | Jones | 482/98 |
| 5,547,444 | A | 8/1996 | Huang | |
| 5,743,832 | A | 4/1998 | Sands et al. | |
| 6,206,808 | B1 * | 3/2001 | Ho | 482/95 |

(Continued)

FOREIGN PATENT DOCUMENTS

| | | |
|---|---|---|
| DE | 29700409 | 3/1997 |
| DE | 29810033 | 8/1998 |
| GB | 2326855 | 1/1999 |

OTHER PUBLICATIONS

International Search Report for PCT/SE2011/050042, Completed by the Swedish Patent Office on Apr. 29, 2011, 3 Pages.

(Continued)

*Primary Examiner* — Jerome W Donnelly
(74) *Attorney, Agent, or Firm* — Brooks Kushman P.C.

(57) ABSTRACT

A training apparatus for training the upper part of the body of a human user. The training apparatus includes a support member with a length axis and an essentially plane support surface intended to carry the user during use of the training apparatus. The support surface is arranged to be turned away from the surface during use of the training apparatus, and two handles for application of forces from the user's hands. The training apparatus includes a first leg member the first end of which is rotatably attached to the support member, and a second leg member the one end of which is rotatably attached to the support member. When applying a force on the handles so that the arms are rotated around the third axis of rotation, the leg members are rotated so that the distance between the support member and the surface increases.

17 Claims, 7 Drawing Sheets

(56) References Cited

U.S. PATENT DOCUMENTS

| | | | | |
|---|---|---|---|---|
| 6,234,942 | B1 * | 5/2001 | Yang | 482/132 |
| 7,169,097 | B1 | 1/2007 | Stearns | |
| 2002/0055423 | A1 * | 5/2002 | Casey et al. | 482/72 |
| 2002/0115537 | A1 | 8/2002 | Lin | |
| 2004/0229737 | A1 | 11/2004 | Stearns | |
| 2006/0189455 | A1 | 8/2006 | Yang | |

OTHER PUBLICATIONS

Extended European Search Report for PCT/SE2011/050042, Dated Jan. 2, 2014, 4 Pages.

* cited by examiner

TRAINING APPARATUS FOR MUSCLES IN THE UPPER PART OF THE BODY

CROSS-REFERENCE TO RELATED APPLICATION

This application is the U.S. national phase of PCT Appln. No. PCT/SE2011/050042 filed on 17 Jan. 2011, which claims priority to SE Patent Application No. 1000039-6 filed on 18 Jan. 2010, the disclosures of which are incorporated in their entirety by reference herein.

TECHNICAL FIELD

The present invention relates to a training apparatus. More specifically the present invention relates to a training apparatus for people for training of muscles in the upper part of the body and in particular the breast muscles.

DESCRIPTION OF THE PRIOR ART

Training of the upper part of the body may be done in a number of different ways. A common way is to do push ups, wherein the feet and the hands have contact with a preferably horizontal surface with the stomach turned against the surface. The arms are used in order to repeatedly heighten and lowering the body in relation to the surface. When performing such push ups the arms will not be loaded with more than approximately half the body weight. For well trained persons there might be a desire to train with a larger load than what is possible with push ups.

An alternative to push ups is bench press which is one of the most common exercises for strength training for strengthening of the breast muscles. A drawback with bench press is that it requires heavy and bulky equipment in the form of a barbell with bench and associated stand for the barbell. Special machines exist which are specially constructed for bench press in which the handle is arranged to act on weights via lines. Such machines are, however, even more bulky and are most commonly found in commercial training facilities.

GB 2326855 describes a device for indoor training and outdoor training in which the body is used as load instead of weights. This means that the device becomes lighter than what would have been the case if weights had been used to create the load for the muscles. The device is primarily intended for training of the back muscles and is not suitable for training of the breast muscles.

SUMMARY OF THE INVENTION

An object of the present invention is to provide a training apparatus for training of the breast muscles, which training apparatus is lighter and less bulky than the training apparatuses according to the prior art.

Another object of the present invention is to provide a training apparatus for training of the breast muscles, which is foldable in order to facilitate storage of the training apparatus in an ordinary home.

A further object of the present invention is to provide a training apparatus for training of the breast muscles, with which the training load may be varied.

At least one of these objects are fulfilled with a training apparatus according to claim 1.

Further advantages of the invention are provided with the features in the dependent claims.

A training apparatus according to the invention may be used for training of particularly the upper part of the body of a human user and is arranged to be placed on a surface.

The training apparatus comprises a support member with a longitudinal axis and an essentially planar support surface intended to carry the user during use of the training apparatus, wherein the support surface defines a plane and extends along the longitudinal axis from a first end to a second end. The support surface is arranged to be turned away from the ground surface during use of the training apparatus, and two handles for application of forces from the hands of the user. The training apparatus is characterized in that it comprises a first leg member the first end of which is rotatably attached to the support member around a first axis of rotation which is essentially parallel to the support surface and the second end of which is arranged to be placed against the ground surface, a second leg member the first end of which is rotatably attached to the With the training apparatus according to the invention the body of the user is used as weight which means that the apparatus may be made relatively light weight and thereby easy to handle and store in a home.

The training apparatus may be arranged so that the leg members are arranged to be rotated in the opposite direction in relation to each other when a force is applied on the handles. This is favourable in that the distance between the second ends of the leg members then may be made longer for a certain distance between the first and the second axes of rotation, compared to the case that the leg members are arranged to be rotated in the same direction. This contributes to the stability of the training apparatus.

The training apparatus may also comprise a first arm and a second arm. The arms may in a first end may be rotatably attached to the support member around a third axis of rotation which is essentially parallel to the support surface. The handles are arranged in the second end of the arms. The training apparatus is arranged so that the leg members are arranged to be rotated so that the distance between the support member and the surface increases when a force is applied on the handles so that the arms are rotated around the third axis of rotation.

The training apparatus may be arranged so that the distance between the end of the support member and the third axis of rotation is less than a third of the length of the support member, preferably less than a fifth of the length of the support member and most preferred less than a tenth of the length of the support member. Thereby the arms become relatively long which is desirable in order to achieve an essentially vertical movement for the handles.

Through the construction with rotatable arms and legs the training apparatus may be made relatively compact when not in use.

Primarily the training apparatus is intended to be used for an exercise similar to bench press. The training apparatus may then be arranged so that the handles are to be moved in the direction away from the surface and the support surface in order to raise the support member from the surface. However, the training apparatus may also be adjustable so that the effect of a force on the handles in a different direction leads to a rising of the support member in relation to the surface.

The first leg member may be constituted of a first leg with a first end and a second end, and a second leg with a first end and a second end, which are arranged with their first ends rotatably attached to the support member. In the corresponding way the second leg member may be constituted of a third leg with a first end and a second end, and a fourth leg with a first end and a second end, which are arranged with their first ends rotatably attached to the support member. It is however possible within the scope of the invention to have the support members in the form of singular legs with an extended foot in their second ends so that a stable arrangement of the training apparatus on a surface thereby is enabled.

Preferably the first axis of rotation and the second axis of rotation are parallel to each other and perpendicular to the length axis of the support member.

Preferably the first axis of rotation and the second axis of rotation are parallel to each other and perpendicular to the longitudinal axis of the support member.

The first leg and the third leg may be arranged with their motions connected to each other, so that the first leg is rotated an angle which is as large as the angle that the third leg is rotated, and wherein the second leg and the fourth leg are arranged with their motions connected to each other so that the second leg is rotated an angle which is essentially as large as the angle that the fourth leg is rotated. Thereby the support surface may be kept in a constant angle in relation to the surface.

Preferably the longitudinal axis of the support surface is parallel to the surface during use.

If the motions of the legs are connected in pairs to each other the support surface may slope if different forces are applied to the different handles. This might be an advantage in order to train both sides of the body equally. Alternatively the motions of all legs may be connected to each other so that all legs are rotated essentially an equally large angle.

The legs may be extendable for change of the gear ratio between the rotational angles of the arms and the height change of the support member in relation to the surface. In this way the resistance may be increased or decreased in order to be adapted to the strength of the user.

The training apparatus may comprise wheels which are arranged in the ends of the first leg and the third leg, which wheels are intended to be in contact with the surface. This facilitates the use and minimizes detrimental effect on the surface during use.

The first arm may be rigidly connected to the first leg so that the third axis of rotation coincides with the first axis of rotation.

As an alternative to having the first arm rigidly connected to the first leg a third wheel may be fixed to the first arm, wherein the motion of the third wheel is connected to the motion of the first and the second wheel. This gives larger flexibility when constructing the training apparatus and also enables a change of the requisite direction of the force on the handles.

The wheels may be cog wheels, wherein the first cog wheel is in engagement with the second cog wheel. Alternatively the wheels may be connected to each other by means of a flexible member.

The wheels may be cog wheels, wherein the flexible member is a chain. Alternatively the wheels may be line wheels and the flexible member may be a wire.

As an alternative to use wheels the training apparatus may comprise a first arm which extends from the first axis of rotation to an outer end at a distance from the first axis of rotation, a second arm which extends from the second axis of rotation to an outer end at a distance from the second axis of rotation and a bracket arranged between the outer end of the first arm and the outer end of the second arm. With such a solution the possible angular motion of the axes of rotation is however limited. At least in the case that it is desirable to use simple arms which are attached in the axes of rotation.

The arms may comprise handle portions on which the handles are arranged, which handle portions are rotatably arranged in the arms in a joint between the handles and the third axis of rotation. The handle portions may be arranged to turn in the opposite direction around the joints in relation to the rotation of the arms around the third axis of rotation. This results in a change of the direction of the requisite force to raise the support member from the surface and thereby an entirely vertical or inclining bench press may be simulated.

As an alternative to having the motions of the legs connected over wheels the motions of the first leg and the third leg may be connected by brackets. It is of course also possible to connect the motions of the legs using other means which in themselves are known to men skilled in the art. Examples on such other means are transfer through a driveshaft or hydraulic transfer.

It is not necessary to arrange the handles on arms as has been described above. Alternatively the handles may be connected to wires which in turn are connected to the legs for affecting the motions of the legs. With wires the exercise that is performed on the machine may be made to resemble ordinary bench press at the cost of somewhat more complicated mechanics.

The training apparatus is arranged for action of a force in an action direction. The training apparatus may be arranged so that the action direction is selectable between directions which are essentially perpendicular to the support surface. This means that the training apparatus may be set between a bench press exercise wherein the action direction is away from the support surface and something that looks like a rowing exercise with the action direction against the support surface. In both cases it is intended that the back of the user is to rest against the support surface.

Inclining bench press may also be simulated by arranging the support surface on a support plate which is slideable in relation to the support member along the longitudinal axis of the support member, wherein the support plate is arranged to be displaced when turning the arms around the third axis of rotation.

Preferably the handles are arranged between the first end of the support surface and the second end of the support surface seen perpendicular from the longitudinal axis. This is preferable during exercises similar to bench press.

SHORT DESCRIPTION OF THE DRAWINGS

In the following the invention will be described in larger detail with reference to the appended drawings on which:

FIG. **6*a*** shows a training apparatus according to a third embodiment of the present invention.

FIG. **6*b*** is a partial enlargement of the connection between the arms and the support plate.

Figure 7:
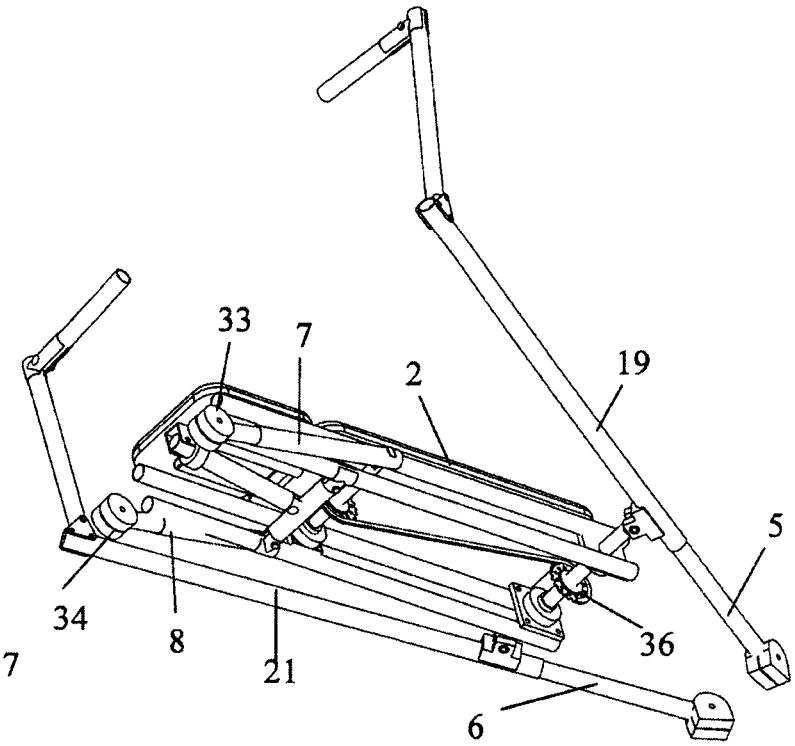

FIG. 7 shows a training apparatus according to a fourth embodiment of the present invention.

Figure 8:
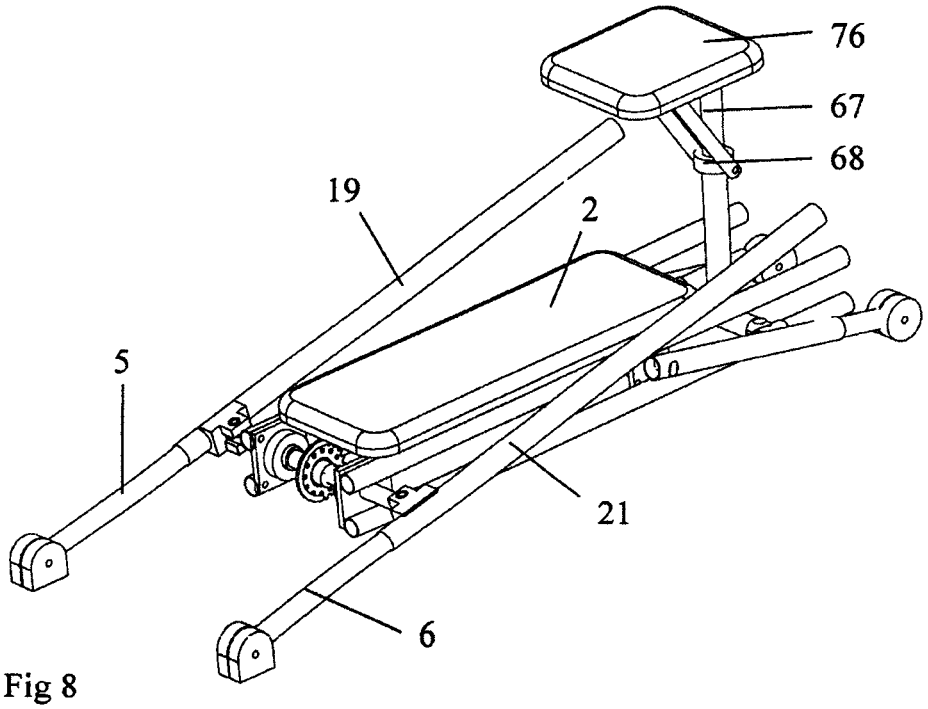

FIG. 8 shows the training apparatus in FIG. 7 in a different position.

Figure 9:
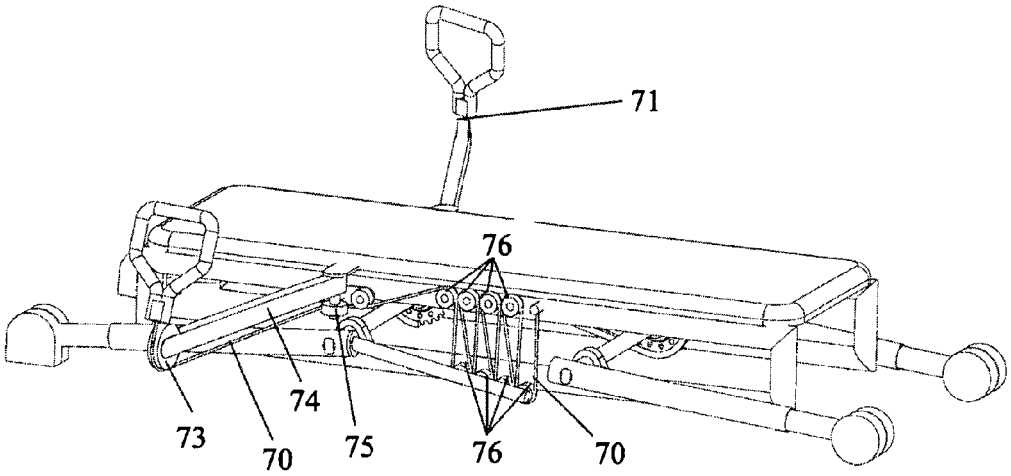

FIG. 9 shows a training apparatus according to a fifth embodiment of the present invention.

Figure 10:
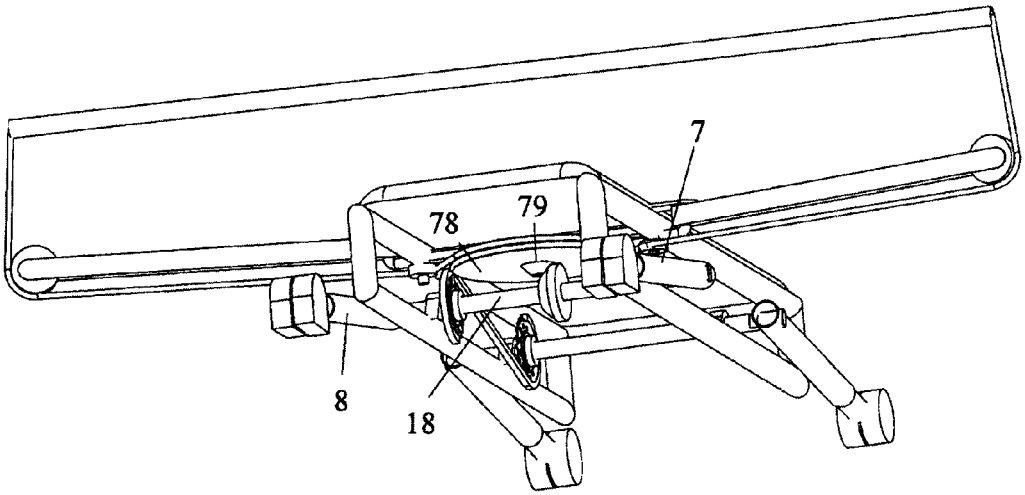

FIG. 10 shows a training apparatus according to a sixth embodiment of the present invention.

Figure 11:
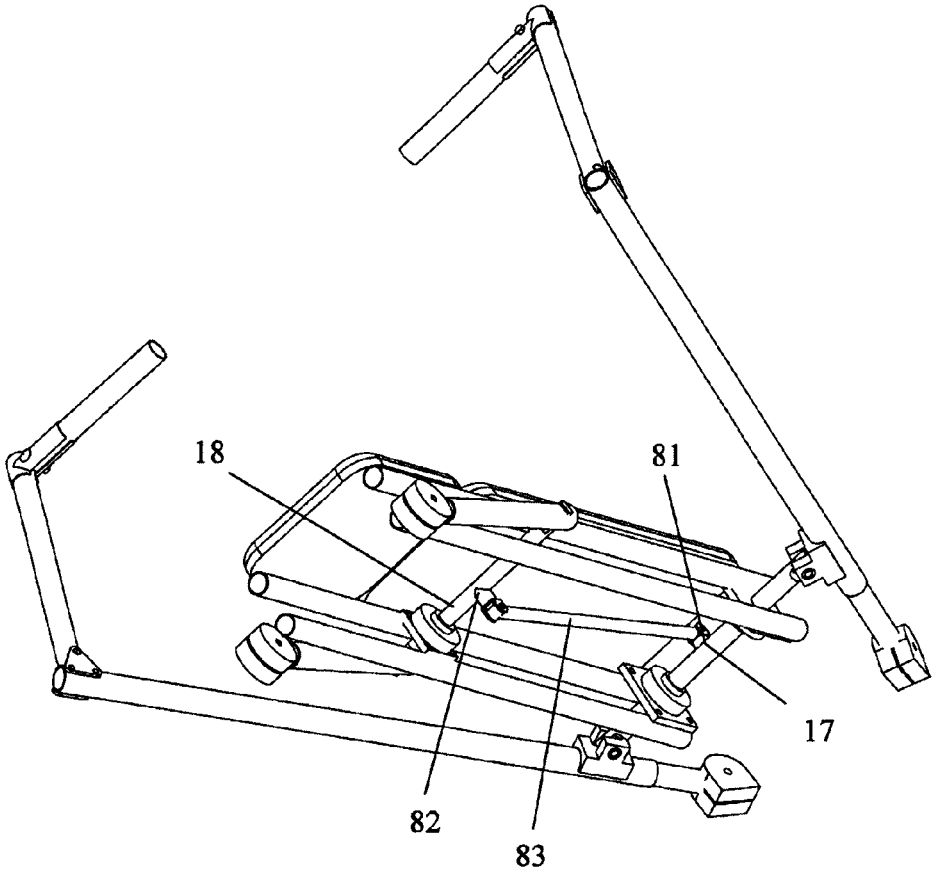

FIG. 11 shows a training apparatus according to a seventh embodiment of the present invention.

DESCRIPTION OF PREFERRED EMBODIMENTS OF THE INVENTION

In the following description of preferred embodiments of the invention similar features in the different figures will be denoted by the same reference numerals. It is to be noted that the drawings are not drawn to scale. In order to not make the drawings cluttered not all reference numerals are in all the figures regarding a certain embodiment.

Figure 1:
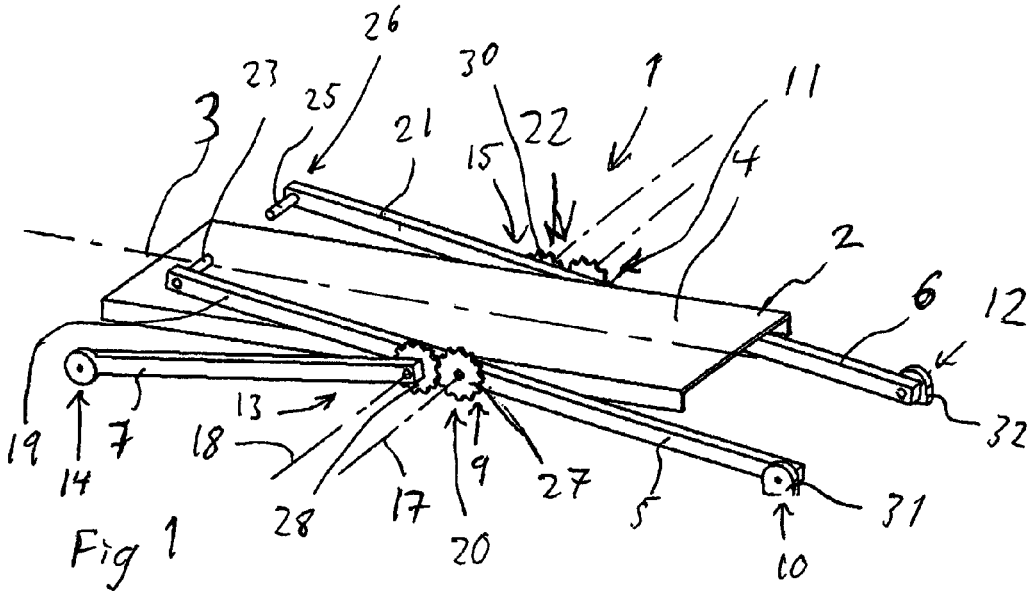
FIG. 1 shows a training apparatus according to a first embodiment of the present invention, in an initial position for the training apparatus.

FIG. 1 shows a training apparatus 1 according to a first embodiment of the present invention, in an initial position for the training apparatus 1. The training apparatus 1 comprises a support member 2 with a longitudinal axis 3 and an essentially plane support surface 4, on which the user places his body during use of the training apparatus 1. The support surface comprises the first end 61 and a second end 62. The training apparatus 1 comprises a first leg member in the form of a first leg 5 and a second leg 6, and a second leg member in the form of a third leg 7 and a fourth leg 8. The first leg 5 has a first end 9 which is rotatably attached to the support member and a second end 10 which is arranged to be placed against a surface during use of the training apparatus 1. The second leg 6, the third leg 7 and the fourth leg 8 comprises in a corresponding way first end 11, 13 and 15, respectively, which are rotatably attached to the support member 2, and a second end 12, 14, and 16, respectively, which are arranged to be placed against the surface. The first leg 5 and the second leg 6 are rotatable around a first axis of rotation 17, while the third leg 7 and the fourth leg 8 are rotatable around a second axis of rotation 18. The training apparatus 1 comprises also a first arm 19 which in its first end 20 is rotatably attached to the support member 2 by being rigidly connected to the first leg 5. Thereby also the first arm 19 is rotatable around the first axis of rotation 17. The training apparatus 1 comprises also a second arm 21 which in its first end 22 is rotatably attached to the support member 2 by being rigidly connected to the second leg 6. Thereby also the second arm 21 is rotatable around the first axis of rotation 17. A first handle 23 is arranged in the second end 24 of the first arm 19 and a second handle 25 is arranged in the second end 26 of the second arm 21. A first cog wheel 27 is fixed in relation to the first leg 5 and thereby also the first arm 19. A second cog wheel 28 is fixed in relation to the third leg 7. The first cog wheel 27 is in engagement with the second cog wheel 28. Thereby the motions of the first leg 5 are connected to the motions of the third leg. In the corresponding way the training apparatus 1 comprises a fourth cog wheel 29 which is fixed in relation to the second leg 6 and a fifth cog wheel 30 which is fixed in relation to the fourth leg 8.

The fourth cog wheel 29 is in engagement with the fifth cog wheel 30, wherein the motions of the second leg 6 are connected to the motions of the fourth leg 8. In the second end 10 of the first leg 5 and in the second end 11 of the third leg 6, there are arranged feet 31, 32, which are rotatably arranged in the legs 5, 6. In the second end 12 of the third leg 7 and the second end 13 of the fourth leg 8 there are arranged wheels 33, 34.

Figure 2:
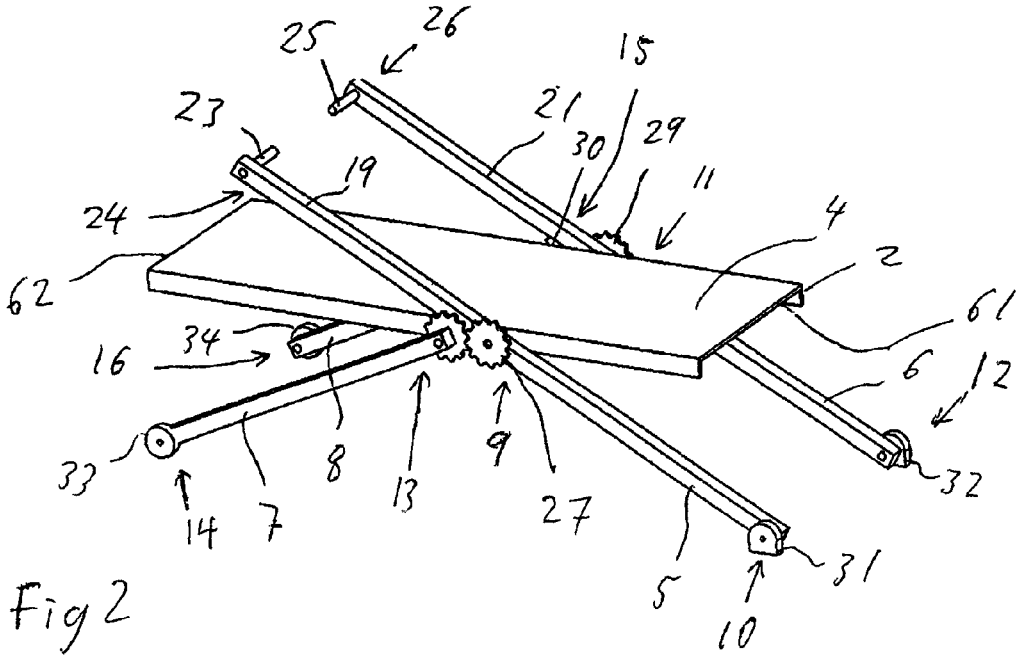
FIG. 2 shows the training apparatus in FIG. 1 in a position when a force is applied on the handles.

FIG. 2 shows the training apparatus 1 in FIG. 1 in a position when a force is applied on the handles 23, 25. The function of a training apparatus 1 according to FIG. 1 and FIG. 2 will now be described. When a user which is placed on the support surface applies a force upwards from the support surface 4 on the handles 23, 25, the arms 19, 21, and thereby also the first leg 5, and the second leg 6, will be rotated around the first axis of rotation 17. Furthermore, the third leg 7 and the fourth leg 8 will be rotated in the opposite direction around the second axis of rotation 18. The support member 2 will then withdraw from the surface on which it is placed. At the same time the second end 10 of the first leg 5 and the second end 11 of the second leg 6 will approach the second end 12 of the third leg 7 and the second end 13 of the fourth leg 8, respectively, by the wheels 33, 34, rolling in the direction against the feet 41, 42. The force that has to be applied on the handles 23, 25, to move the support member 2 upwards from the surface depends on the weight of the user.

Figure 3:
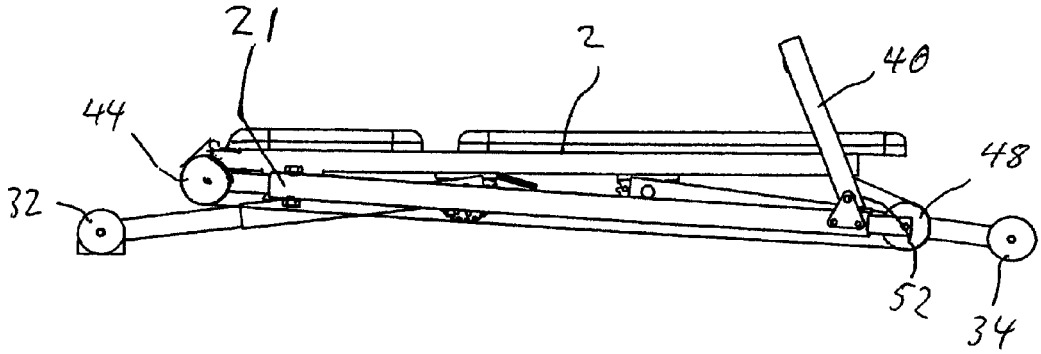
FIG. 3 shows a training apparatus according to a second embodiment of the present invention.
Figure 4:
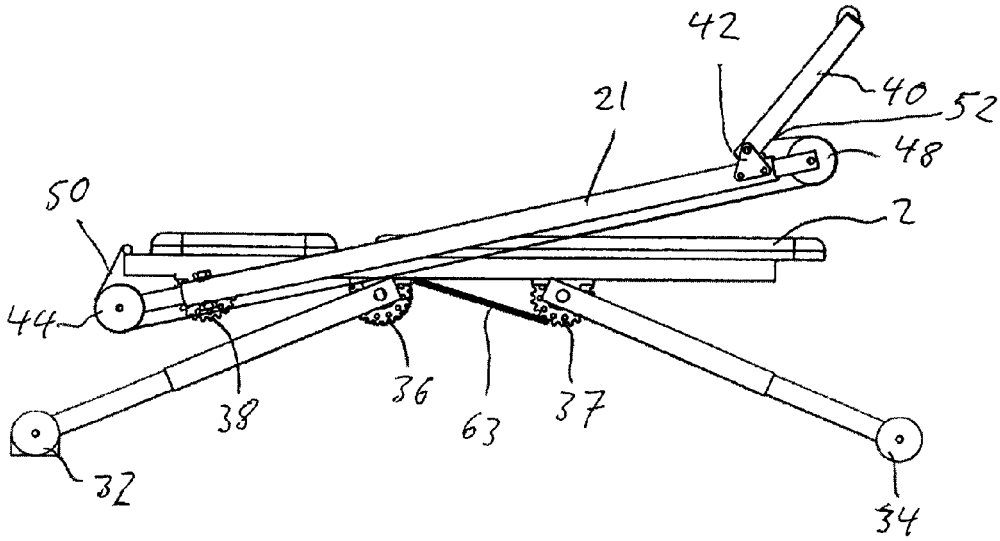
FIG. 4 shows the training apparatus in FIG. 3 in a position when a force is applied on the handles.
Figure 5:
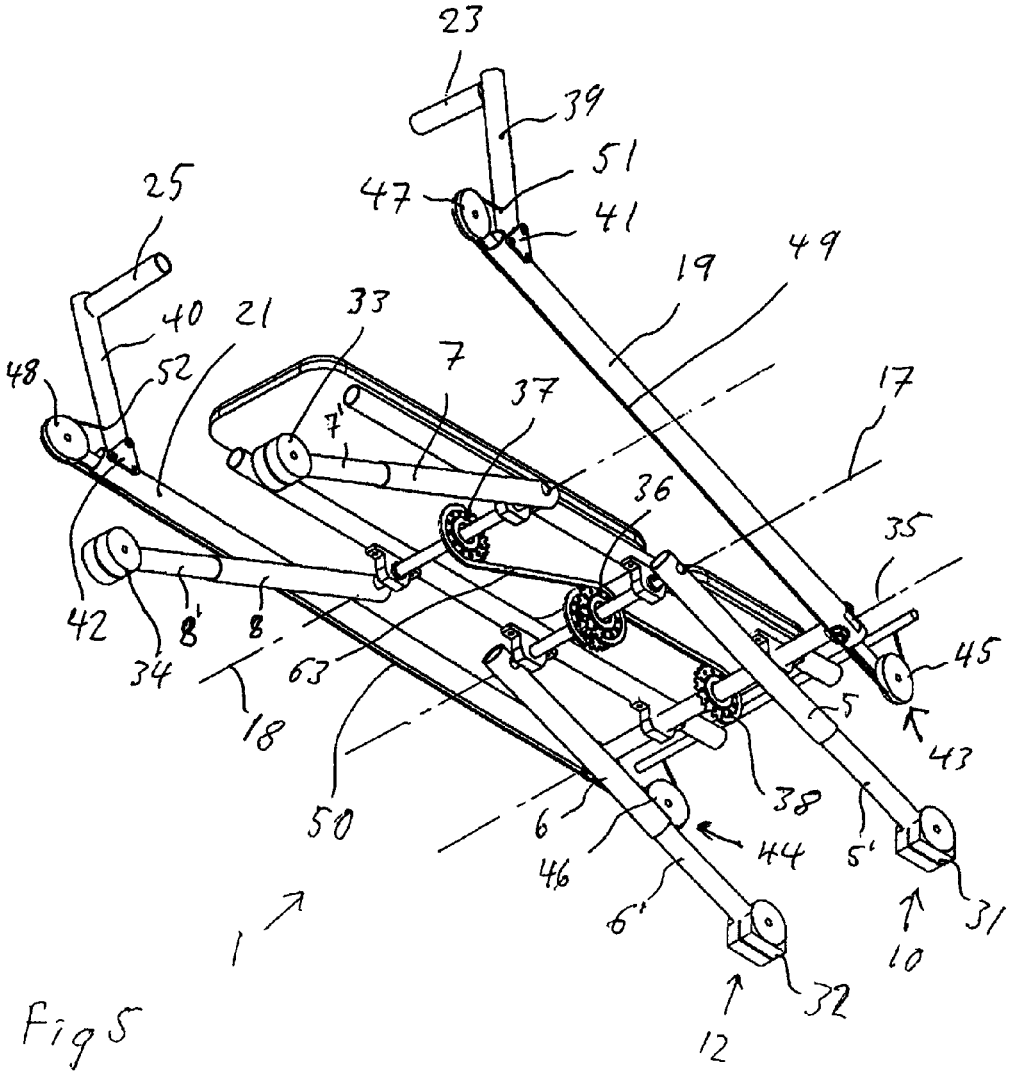
FIG. 5 is a perspective view seen from below of the training apparatus in FIG. 3.

FIG. 3, FIG. 4 and FIG. 5 shows a training apparatus 1 according to an alternative embodiment of the present invention. In FIG. 3 the training apparatus 1 is shown in the initial position before a force has been applied on the handles 23, 25. Only the differences between the embodiments will be described in detail. The first arm 19 and the second arm 21 are arranged rotatable around a third axis of rotation 35 and both are fixed in relation to a third cog wheel 38. The arms 19, 21 are thus not rigidly connected to any of the legs 5-8. The first leg 5 and the second leg 6 are both fixed in relation to a first cog wheel 36. The third leg 7 and the fourth leg 8 are both fixed in relation to a second cog wheel 37. The motions of the first cog wheel 36, the second cog wheel 37 and the third cog wheel 38 are connected by a chain 63 which runs over the cog wheels 36-38. By acting on the handles 23, 25, with a force the legs 5-8 will be rotated and the distance between the support member 2 and the surface will increase. By rearranging how the chain 63 runs over the third cog wheel 38 the necessary force direction, to raise the support member in relation to the surface, may be changed. This enables different sorts of exercises to be performed with the training apparatus. The arms 19, 21, comprise handle portions 39, 40, on which the handles 23, 25, are arranged. The handle portions 39, 40, are rotatably arranged in the arms 19, 21, in joints 41, 42, between the handles 23, 25, and the third axis of rotation 35. The arms 19, 21, extend a portion past the third axis of rotation to a lever point 43, 44, in which first lever wheels 45, 46 are arranged. In the corresponding way a second lever wheel 47, 48, are arranged on the arms beyond the joints 41, 42. A wire 49, 50, is arranged for each one of the arms 19, 21, between the support member 2, via the first lever wheel 45, 46, via the second lever wheel 47, 48, to a fastening point 51, 52, on the handle portions 39, 40. This means that the handle portions 39, 40, are rotated in the opposite direction around the joints 41, 42, in relation to the rotation of the arms 19, 21, around the third axis of rotation 35. The positions of the fastening points 51, 52, on the handle portions 39, 40, affect the gear ratio between the motions of the arms and the motions of the handle portions 39, 40.

For a user which lays still on the support surface this will be apprehended as a movement of the handles along the longitudinal axis 3 of the support member 2. As is evident from the figure the legs 5-8 are telescopically extendable and comprise an outer part 5'-8'.

FIG. 4 shows the training apparatus in FIG. 3 in a position when a force is applied on the handles 23, 25. As is evident from the figure the handle portions 39, 40, have been rotated in the opposite direction to the arms 19, 21. FIG. 5 is a perspective view at an angle from below of the training apparatus in FIG. 3.

In the embodiment shown in FIG. 3-5 the arms 19, 21, in the initial position of the training apparatus are essentially parallel to the support surface 4. The training apparatus may, however, within the scope of the invention be arranged so that the positions of the arms 19, 21, are adjustable. Furthermore, the training apparatus may be adjustable so that the rotational direction of the arms giving a raise of the support surface is reversible. This may be provided either by means of a reverse gear (not shown) or by changing the engagement side for the chain over the third cog wheel 38. With the described adjustment possibilities the arms may be set to be directed essentially straight up from the support surface 4 in the initial position of the training apparatus 1. This enables performing an exercise which at least partly resembles rowing.

Figure 6A:
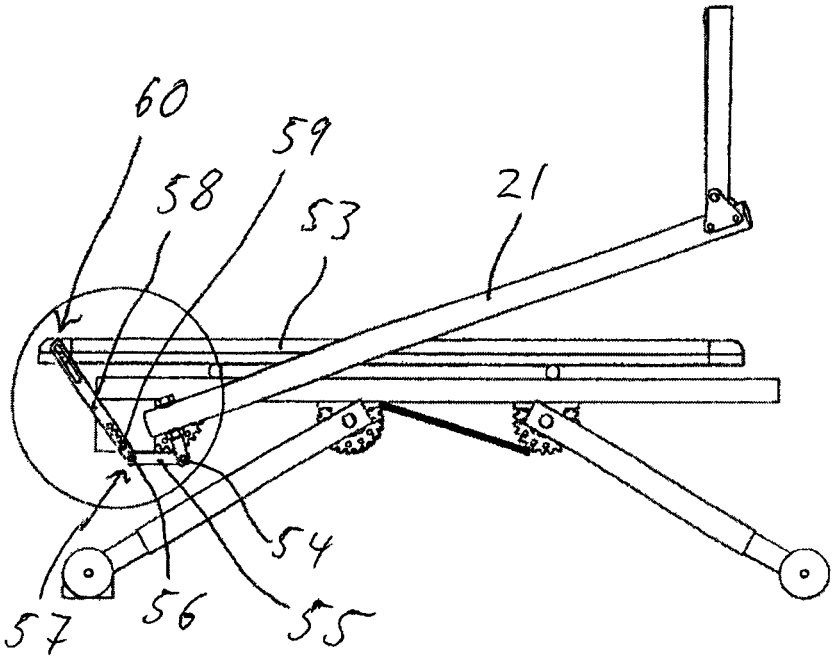
Figure 6B:
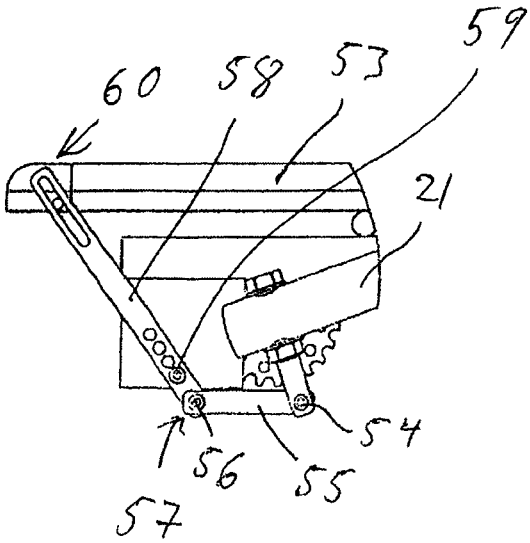

FIG. 6*a* shows a training apparatus according to an alternative embodiment of the present invention. Only the differences between the embodiment in FIG. 3-5 and the embodiment in FIG. 6 will be described. The support member 2 comprises a support plate 53 which is slidable in relation to the support member 2 along the longitudinal axis 3 of the support member 2. During 5 rotation of the arms 19, 21, the support plate will be slided along the longitudinal axis 3 acted upon by the arms 19, 21, via a linkage which is evident in larger detail in FIG. 6*b* which is a partial enlargement of the linkage between the arms 19, 21 and the support plate 53. As is evident from FIG. 6*b* a first joint 54 is fixed to the arm 21. A first bracket 55 is arranged articulated between the first articulation point 54 and a second articulation point 56 in a first end 57 of a second articulation arm 58. The second articulation arm 58 is rotatable around an articulation arm rotational axis 59 and acts in its other end 60 on the support plate 53.

FIG. 7 shows a training apparatus 1 according to a fourth embodiment of the present invention. Only the parts of the training apparatus which differs from the third embodiment in FIG. 5 will be described. FIG. 8 shows the training apparatus 1 in FIG. 7 in a different position. The first arm 19 is rigidly connected to the first leg 5 and the second arm 21 is rigidly connected to the second leg 6. The first leg 5 and the first arm 19 are rotatable around the second axis of rotation 17. In the corresponding way the second leg 6 and the second arm 21 are rotatable around the second axis of rotation 17 but are rotationally coupled to the first arm 19 and the first leg 5. The legs 5, 6, may also be rotated around the axes of rotation 64, 65, so that the distance between the second ends 10, 12, of the legs may be varied and thereby also the distance between the handles 23, 25, in order to be adapted to the size of the user. In contrast to the device according to the third embodiment the training apparatus according to the fourth embodiment has only two axes of rotation. In FIG. 8 the training apparatus is shown with a breast support plate 66 raised. A user may rest his chest against the breast support plate in order to perform an inverse exercise similar to a rowing exercise. With such a breast support plate 66 two different exercises may be performed without the need of being able to reverse the direction of the transmission. As is evident from the figures the second axis of rotation is arranged close to the foot end on the support member 2. The distance between the second axis of rotation 17 and the end on the support member 2 is less than a tenth of the longitudinal of the support member 2. The breast support plate 66 is rotatably arranged on a first support pole 67 which in turn is rotatably attached to the support member 2. A sleeve 68 is arranged on a second support pole 80. The first support pole 67 is telescopically insertable in the second support pole 80. Two stays 69 are rotatably arranged in the breast support plate 66. and in the sleeve 68. In the position shown in FIG. 8 the support pole 67 is raised and the breast support plate 66 is angled.

FIG. 9 shows a training apparatus 1 according to a fifth embodiment of the present invention. Only the differences in relation to the training apparatus 1 according to the fourth embodiment will be described. The arms 19, 21, are shorter than in the embodiment shown FIG. 7 and FIG. 8. A first wire 70 is attached to the first handle 72 and runs via a first return wheel 73, which is arranged on an arm 74 which is rotatably attached to the support device 2, to a second return wheel 75. The wire 70 runs from the second return wheel 75 to a number of block wheels 76 arranged on the support device and the arm 19 and is finally attached to the support device 2. A second wire 71 is arranged in the corresponding way on the other side of the training apparatus 1 and is manoeuvered with a second handle 77.

FIG. 10 shows a training apparatus 1 according to a sixth embodiment of the present invention. Only the differences in relation to the embodiment in FIG. 9 will be described. The handles 72, 77, are replaced by a pole in the ends of which the wires are attached. The wires runs to a line wheel 78 arranged under the support member 2. The line wheel 78 is connected to the first axis 18 via an angular gear 79.

FIG. 11 shows a training apparatus according to a seventh embodiment of the present invention. Only the differences in relation to the embodiment in FIG. 7 will be described. In FIG. 11 the first arm 81 is arranged on the first axis of rotation 17 and a second arm 82 is arranged on the second axis of rotation 18. The training apparatus also comprises a bracket 83. A first end of the bracket is attached articulated in the first arm 81 and a second end of the bracket is attached articulated in the second arm 82. The rotation of the first axis of rotation is connected to the second axis of rotation by means of said bracket 83.

The described embodiments may be varied in many ways without departing from the spirit and scope of the invention which is limited only by the appended claims.

It is possible to replace the cog wheels and the chains with line wheels and wires or links.

The invention claimed is:

1. A training apparatus which may be used for training of particularly an upper part of the body of a human user and which is arranged to be placed on a ground surface, comprising:

a support member with a longitudinal axis and an essentially planer support surface intended to carry the user during use of the training apparatus, wherein the support surface defines a plane and extends along the longitudinal axis from a first end to a second end, which support surface is arranged to face away from the ground surface during use of the training apparatus, two handles for application of forces from the hands of the user, which handles either are movable in relation to each other or are fixed in relation to each other, a first leg with a first end and a second end, and a second leg with a first end and a second end, which are arranged with their first ends attached rotatably in the support member around a first axis of rotation which is essentially parallel to the support surface, and with their second ends arranged to be placed against the ground surface, and a third leg with a first end and a second end, and a fourth leg with a first end and a second end, which are attached rotatably in the support member around a second axis of rotation which is essentially parallel to the support surface and with their second ends arranged to be placed against the ground surface, wherein the training apparatus is arranged so that the leg members are arranged to be rotated so that the distance between the support member and the ground surface increases when a force is applied on the handles, a first arm and a second arm, wherein the arms in a first end are rotatably attached to the support member around a third axis of rotation which is essentially parallel to the support surface and in the second end of which the handles are arranged, wherein the training apparatus is arranged so that the leg members are arranged to be rotated in the opposite direction in relation to each other so that the distance between the support member and the ground surface increases, when a force is applied to the handles so that the arms are rotated around the third axis of rotation, wherein the distance between the first end of the support member and the third axis of rotation is less than a third of the length of the support member, and wherein the handles are closer to the second end of the support member than to the first end of the support member.

2. The training apparatus according to claim 1, wherein the first leg and the third leg are arranged with their motions connected to each other, so that the first leg is rotated essentially an equal angle as the third leg, and wherein the second leg and the fourth leg are arranged with their motions connected to each other so that the second leg is rotated essentially an equal angle as the fourth leg.

3. The training apparatus according to claim 2, wherein all legs have their motions connected to each other so that all legs are rotated essentially equal angles.

4. The training apparatus according to claim 1, wherein the legs are extendable for change of the lever arm ratio between the rotational angle of the arms and the height change of the support member in relation to the ground surface.

5. The training apparatus according to claim 1, comprising a first wheel which is fixed in relation to the first leg, and a second wheel which is fixed in relation to the third leg, wherein the motions of the first leg and the third leg are connected via the wheels.

6. The training apparatus according to claim 1, wherein the first arm is rigidly connected to the first leg so that the third axis of rotation coincides with the first axis of rotation.

7. The training apparatus according to claim 1, wherein a third wheel is fixed in relation to the first arm, wherein the motion of the third wheel is connected to the motion of the first wheel and the second wheel.

8. The training apparatus according to claim 7, wherein the wheels are cog wheels, wherein the first cog wheel is in engagement with the second cog wheel.

9. The training apparatus according to claim 7, wherein the wheels are connected to each other by means of a flexible member.

10. The training apparatus according to claim 9, wherein the wheels are cog wheels and wherein the flexible member is a chain.

11. The training apparatus according to claim 1, comprising a third arm which extends from the first axis of rotation to an outer end at a distance from the first axis of rotation, a fourth arm which extends from the second axis of rotation to an outer end at a distance from the second axis of rotation and a bracket arranged between the outer end of the first arm and the outer end of the second arm.

12. The training apparatus according to claim 1, wherein the arms comprise handle portions on which the handles are arranged, which handle portions are rotatably arranged in the arms in a joint between the handles and the third axis of rotation.

13. The training apparatus according to claim 12, wherein the handle portions are arranged to be rotated in the opposite direction around the joints in relation to the rotation of the arms around the third axis of rotation.

14. The training apparatus according to claim 1, wherein the support surface is arranged on a support plate which is slidable in relation to the support member along the longitudinal axis of the support member, wherein the support plate is arranged to be displaced when the arms are rotated around the third axis of rotation.

15. The training apparatus according to claim 1, wherein the handles are arranged between the first end of the support surface and the second end of the support surface seen perpendicularly from the longitudinal axis.

16. The training apparatus according to claim 1, wherein the force of the handles is arranged to be applied in a direction of actuation.

17. The training apparatus according to claim 16, wherein the direction of actuation is arranged to be selectable between directions which are essentially perpendicular to the support surface.

* * * * *